US012487037B2

(12) United States Patent
Ryon et al.

(10) Patent No.: US 12,487,037 B2
(45) Date of Patent: Dec. 2, 2025

(54) FLEXURAL SUPPORT FOR HEAT EXCHANGER CORES

(71) Applicant: Hamilton Sundstrand Corporation, Charlotte, NC (US)

(72) Inventors: Jason A. Ryon, Carlisle, IA (US); Raffi Mangoyan, Manchester, CT (US); Ousmane Gaye, Hartford, CT (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 670 days.

(21) Appl. No.: 17/879,544

(22) Filed: Aug. 2, 2022

(65) Prior Publication Data

US 2024/0044590 A1 Feb. 8, 2024

(51) Int. Cl.
*F28F 9/00* (2006.01)

(52) U.S. Cl.
CPC ..... *F28F 9/005* (2013.01); *F28F 9/001* (2013.01); *F28F 2230/00* (2013.01); *F28F 2240/00* (2013.01)

(58) Field of Classification Search
CPC .... F28F 2240/00; F28F 2230/00; F28F 9/001; F28F 9/005; F28D 2001/0273
See application file for complete search history.

(56) References Cited

U.S. PATENT DOCUMENTS 3,324,007 A 6/1967 Harry
3,889,744 A * 6/1975 Hill ..... F28F 7/02 165/83
4,482,011 A * 11/1984 Jacquet ..... B60H 1/00521 165/149
5,065,816 A * 11/1991 Darragh ..... F28D 9/0018 165/125
5,088,552 A * 2/1992 Raunio ..... F28F 3/046 165/165
6,223,808 B1 * 5/2001 Tsunoda ..... F28D 9/0025 165/162
6,302,402 B1 * 10/2001 Rynders ..... F28F 21/04 277/653
6,474,408 B1 11/2002 Yeh et al.
6,789,605 B1 9/2004 Kaser
(Continued)

FOREIGN PATENT DOCUMENTS

DE 102017206670 A1 12/2017
EP 3854505 A1 7/2021
WO 2018068150 A1 4/2018

OTHER PUBLICATIONS

Extended European Search Report for EP Application No. 23188529.4, Dated Dec. 4, 2023, pp. 7.

*Primary Examiner* — Devon Lane
(74) *Attorney, Agent, or Firm* — Kinney & Lange, P.A.

(57) ABSTRACT

A heat exchanger includes a heat exchanger core, a pressure housing, and a flex beam. The pressure housing at least partially defines a core chamber. The flex beam extends between and connects the heat exchanger core and the pressure housing such that the heat exchanger core is suspended away from the pressure housing within the core chamber by the flex beam. The flex beam includes a core end connected to the heat exchanger core and a housing end spaced along the flex beam from the core end and connected to the pressure housing.

20 Claims, 5 Drawing Sheets

(56) References Cited

U.S. PATENT DOCUMENTS

| | | | | |
|---|---|---|---|---|
| 8,196,845 | B2 * | 6/2012 | Thomson | F23D 11/107 239/397.5 |
| 9,541,197 | B2 * | 1/2017 | Contreras | B29C 43/203 |
| 2015/0068717 | A1 | 3/2015 | Gluck | |
| 2015/0285572 | A1 | 10/2015 | Fleitling et al. | |
| 2017/0067589 | A1 * | 3/2017 | Ishikawa | F28F 3/08 |
| 2019/0277536 | A1 * | 9/2019 | Giannoni | F24H 9/146 |
| 2021/0231391 | A1 * | 7/2021 | Colson | F28F 9/002 |
| 2021/0270535 | A1 * | 9/2021 | Schönberger | F28D 7/022 |

* cited by examiner

FLEXURAL SUPPORT FOR HEAT EXCHANGER CORES

BACKGROUND

The present disclosure relates to heat exchangers. More specifically, the present disclosure relates to supporting heat exchanger cores relative to heat exchanger housings.

Heat exchangers are often used to transfer heat between two fluids. For example, in aircraft environmental control systems, heat exchangers may be used to transfer heat between a relatively hot air source (e.g., bleed air from a gas turbine engine) and a relatively cool air source (e.g., ram air). Heat exchanger cores are typically directly attached to a heat exchanger housing. Thermal stresses are generated at the connection points because of thermal differences between the core and the housing. Additional mechanical stresses are also typically experienced at the connection points due to pressurization within the housing. The thermal and mechanical stresses cause areas of significant stress concentration between the core and the housing.

SUMMARY

According to an aspect of the present disclosure, a heat exchanger includes a heat exchanger core, a pressure housing, and a flex beam. The pressure housing at least partially defines a core chamber. The flex beam extends between and connects the heat exchanger core and the pressure housing such that the heat exchanger core is suspended away from the pressure housing within the core chamber by the flex beam. The flex beam includes a core end connected to the heat exchanger core and a housing end spaced along the flex beam from the core end and connected to the pressure housing.

According to an additional or alternative aspect of the present disclosure, a heat exchanger includes a heat exchanger core, a pressure housing, and a first flex beam. The pressure housing at least partially defines a core chamber. The pressure housing extends about an axis. The first flex beam extends between and connects the heat exchanger core and the pressure housing. The first flex beam includes a core arm, a flex beam body, and a housing arm. The core arm of the first flex beam extends between a core interface, at which a core end of the flex beam interfaces with the heat exchanger core, and a flex beam body of the first flex beam. A housing arm of the first flex beam extends between a housing interface, at which a housing end of the flex beam interfaces with the pressure housing, and the flex beam body. The flex beam body is elongate along the axis. The core arm extends radially and axially between the flex beam body and the heat exchanger core. The housing arm extends radially and axially between the flex beam body and the pressure housing. The first flex beam supports the heat exchanger core within the core chamber such that a spacing gap is formed radially between the heat exchanger core and the pressure housing.

DETAILED DESCRIPTION

Figure 1A:
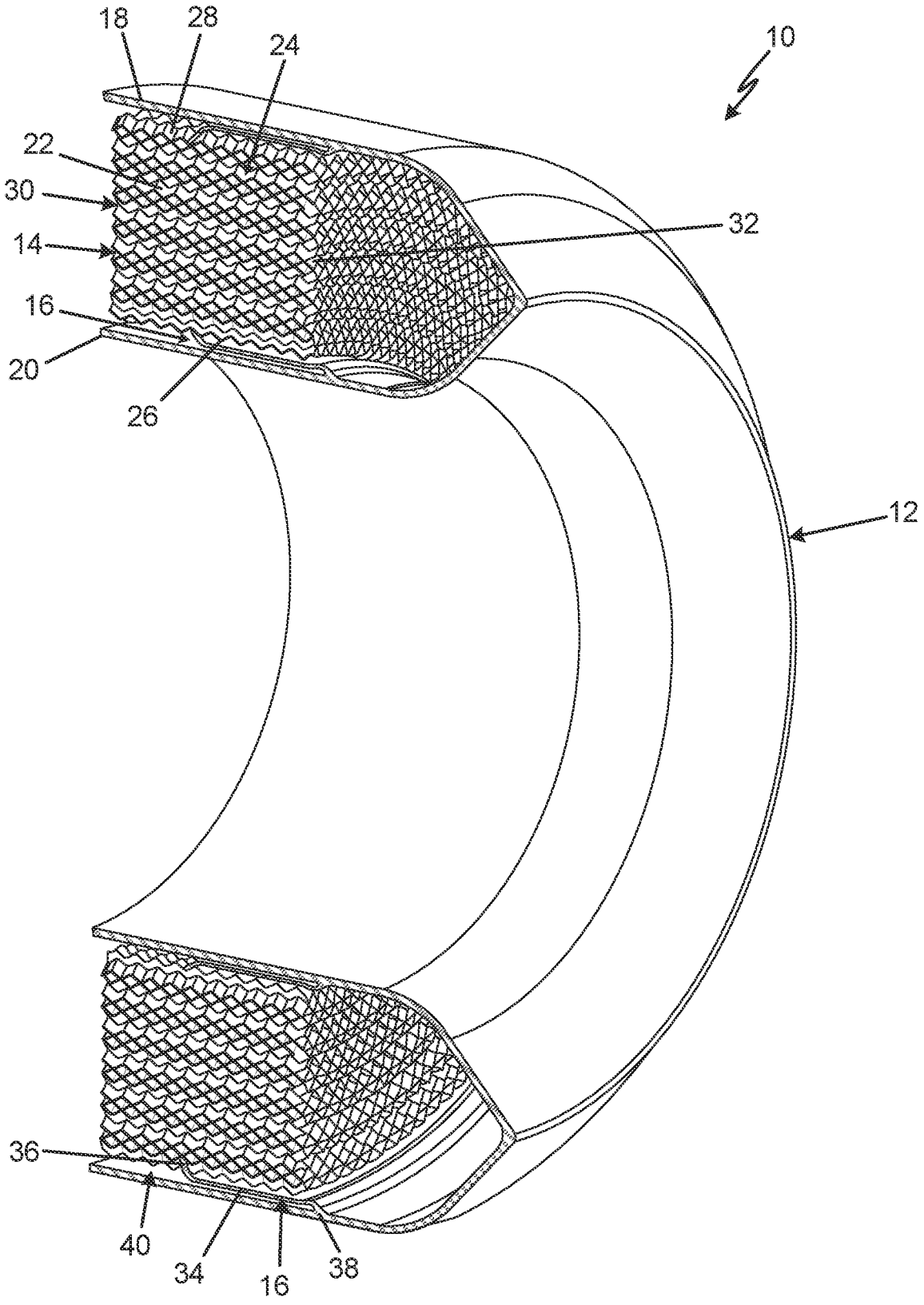
FIG. 1A is an isometric cross-sectional view of a heat exchanger.
Figure 1B:
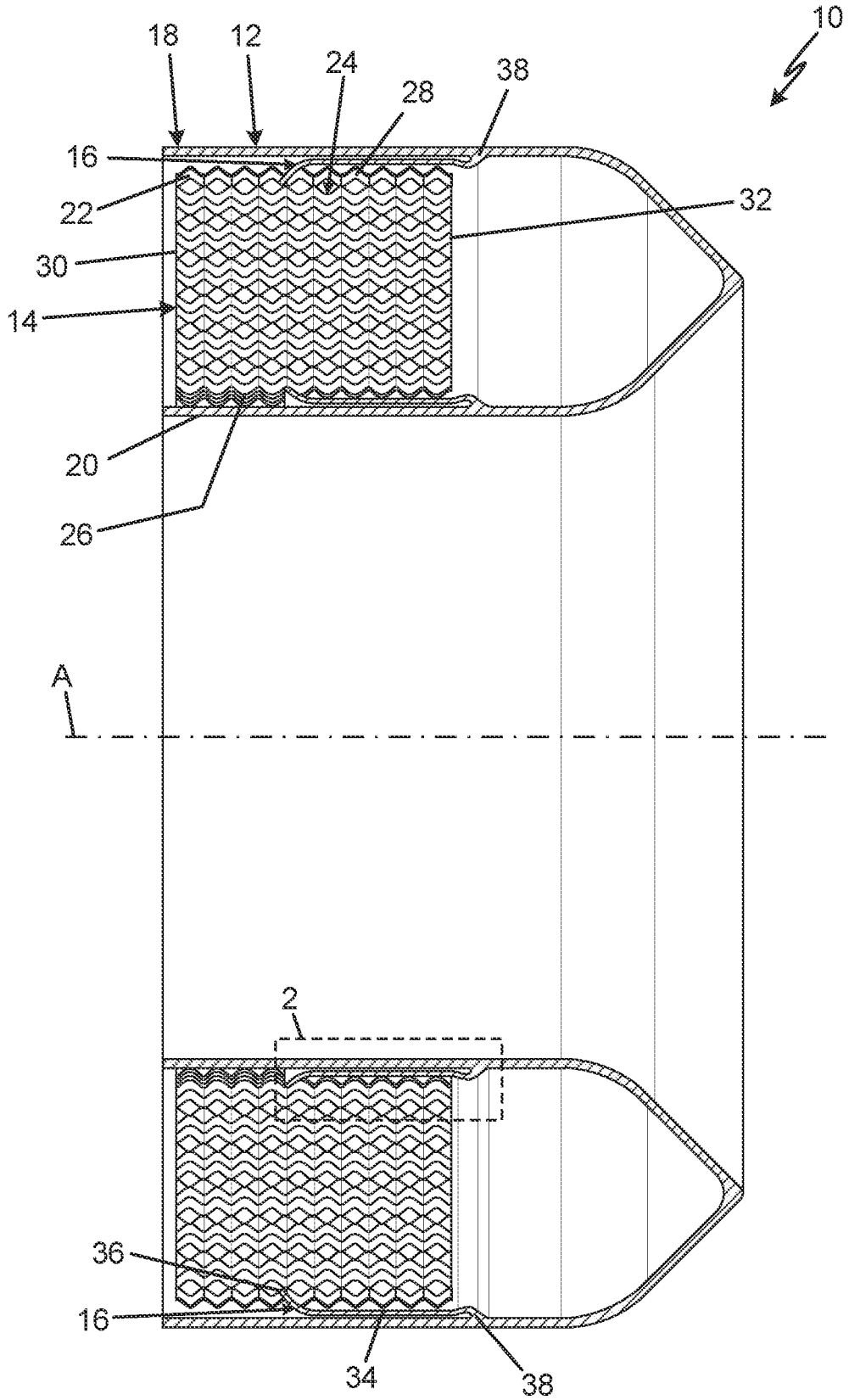
FIG. 1B is a planar view of the cross-section shown win FIG. 1A.

FIG. 1A is an isometric cross-sectional view of heat exchanger 10. FIG. 1B is a planar view of the cross-section shown in FIG. 1A. FIGS. 1A and 1B will be discussed together. Heat exchanger 10 includes pressure housing 12, heat exchanger core 14, and flex beams 16. Pressure housing 12 includes outer housing wall 18 and inner housing wall 20. Heat exchanger core 14 includes plates 22, passages 24, inner side 26, outer side 28, upstream end 30, and downstream end 32. Flex beam 16 includes flex body 34, core end 36, and housing end 38.

Pressure housing 12 surrounds heat exchanger core 14. Pressure housing 12 is configured to mount within a system for which heat exchange is desired. The fluids for which heat exchange are desired flow into and exit from pressure housing 12. The fluids thermally interact within heat exchanger core 14. In the example shown, heat exchanger 10 is an annular cylindrical heat exchanger that extends about axis A. Outer housing wall 18 extends about axis A. Outer housing wall 18 extends fully about axis A. Outer housing wall 18 is the radially outer one of the walls of pressure housing 12. Inner housing wall 20 extends about axis A. Inner housing wall 20 extends fully about axis A. Inner housing wall 20 is the radially inner one of the walls of pressure housing 12. Inner housing wall 20 is spaced from outer housing wall 18 radially relative to axis A to form a core chamber 40 within which heat exchanger core 14 is disposed. Inner housing wall 20 is formed as a hollow cylinder. Axis A of heat exchanger 10 extends through the hollow space within inner housing wall 20. Both outer housing wall 18 and inner housing wall 20 form housing walls of pressure housing 12.

In the example shown, pressure housing 12 includes two perimeter walls (outer housing wall 18 and inner housing wall 20) that are separately formed as cylindrical walls that have circular cross-sectional shapes in a plane orthogonal to axis A. It is understood, however, that not all examples are so limited. For example, pressure housing 12 can include a single housing wall about the perimeter of heat exchanger core 14, which single wall can be formed to have a cross-section of any desired shape in a plane orthogonal to the heat exchanger axis A, such as a circle, oval, square, rectangle, polygon, or any other desired shape. In the example shown, pressure housing 12 is illustrated as including a closed axial end. It is understood, however, that not all examples are so limited.

Heat exchanger core 14 is disposed within pressure housing 12. In the example shown, heat exchanger core 14 includes plates 22 that are stacked together to define passages 24. Heat exchanger core 14 is configured such that a first fluid flows through a first set of passages 24 and a second fluid flows through a second set of passages 24. The first and second sets of passages 24 are fluidly isolated from each other by plates 22 to prevent mixing of the fluids. Plates 22 are thermally conductive to facilitate heat transfer between the fluids flowing through heat exchanger core 14. In some examples, one of the fluids flows generally axially and the other fluid flows generally circumferentially, though it is understood that not all examples are so limited.

Flex beams 16 are disposed within pressure housing 12. Each flex beam 16 extends between and connects pressure housing 12 and heat exchanger core 14. Each flex beam 16 includes a flex body 34 that is elongated relative to axis A.

Core end 36 of each flex beam 16 connects to heat exchanger core 14. Specifically, core end 36 connects to heat exchanger core 14 at core interface 42. Housing end 38 of each flex beam 16 connects to pressure housing 12. Specifically, housing end 38 connects to pressure housing 12 at housing interface 44. It is understood that flex beams 16 can be connected to pressure housing 12 and heat exchanger core 14 in any desired manner. In some examples, flex beams 16 can be welded, brazed, or otherwise permanently attached to one or both of pressure housing 12 and heat exchanger core 14. In some examples, flex beams 16 can be integrally formed with one or both of pressure housing 12 and heat exchanger core 14. For example, flex beam 16 and one or both of pressure housing 12 and heat exchanger core 14 can be integrally formed as a unitary, monolithic structure by additive manufacturing.

Flex beam 16 extends between core end 36 and housing end 38. In the example shown, a first flex beam 16 is connected to outer wall 18 of pressure housing 12 and to outer side 28 of heat exchanger core 14 and a second flex beam 16 is connected to inner wall 20 of pressure housing 12 and to inner side 26 of heat exchanger core 14. The first flex beam 16 can also be referred to as an outer flex beam or a radially outer flex beam. The second flex beam 16 can also be referred to as an inner flex beam or a radially inner flex beam. The first and second flex beams 16 are formed as separate structures in the example shown.

Flex beams 16 connect to pressure housing 12 and heat exchanger core 14 to support heat exchanger core 14 relative to pressure housing 12. Flex beams 16 support heat exchanger core 14 such that heat exchanger core 14 floats within core chamber 40 defined by pressure housing 12. Flex beams 16 support heat exchanger core 14 such that support gaps 46 are formed between pressure housing 12 and heat exchanger core 14. Support gaps 46 can be considered to have a housing gap 46*a* between flex beam 16 and pressure housing 12 and a core gap 46*b* between flex beam 16 and heat exchanger core 14. Heat exchanger core 14 is spaced radially from and not in contact with pressure housing 12. Outer side 28 is spaced radially from outer wall 18 and not in contact with outer wall 18. Inner side 26 is spaced radially from inner wall 20 and not in contact with inner wall 20. In the example shown, flex beams 16 support heat exchanger core 14 such that heat exchanger core is not in direct contact with pressure housing 12. Heat exchanger core 14 is supported away from pressure housing 12.

In the example shown, each flex beam 16 is formed to extend fully about axis A. Each flex beam 16 extends fully about heat exchanger core 14 and fully about pressure housing 12. Flex beams 16 can be formed as solid structures that support heat exchanger core 14 and provide seals that prevent fluid from flowing around heat exchanger core 14 within support gaps 46 formed between pressure housing 12 and heat exchanger core 14. Flex beams 16 can seal support gaps 46 such that support gaps 46 are axially closed to prevent any fluid from flowing around heat exchanger core 14 through support gaps 46. While flex beams 16 are described as solid structures extending fully about heat exchanger core 14, it is understood that not all examples are so limited. For example, outer flex beam 16 can be formed as an annular array of individual flex beam members that interface with heat exchanger core 14 and pressure housing 12 to support heat exchanger core 14. In some examples, flex beam 16 can be formed such that housing end 38 is formed by an array of multiple fingers disposed annularly about the axis A with gaps circumferentially therebetween. In some examples, flex beam 16 can be formed such that core end 36 is formed by an array of multiple fingers disposed annularly about the axis A with gaps circumferentially therebetween. A separate seal can be disposed between heat exchanger core 14 and pressure housing 12 to prevent undesired bypass flow around heat exchanger core 14.

During operation, fluids flow through heat exchanger core 14 to facilitate heat exchange between the fluids. Heat exchanger 10 experiences different temperatures at different regions of heat exchanger 10 during operation. The thermal gradient causes thermal stresses to the components of heat exchanger 10. For example, the temperature of heat exchanger core 14 can be higher than the temperature of pressure housing 12, and the temperature of the interior of pressure housing 12 can be higher than the environmental temperature around the exterior of pressure housing 12. Components of heat exchanger 10 also experience mechanical stresses due to fluid pressure. The mechanical stresses can be particularly high at direct interfaces between heat exchanger core 14 and pressure housing 12 due to differential pressures inside heat exchanger core 14, in pressure housing 12, and outside of pressure housing 12.

Flex beams 16 support heat exchanger core 14 away from pressure housing 12 such that the thermal gradient is spread along a length of flex beam 16. Flex beam 16 is further configured to flex in response to thermal growth of heat exchanger core 14. Heat exchanger core 14 can expand into support gaps 46 on either radial side of heat exchanger core 14 without directly contacting pressure housing 12. Flex beam 16 thereby allows for thermal expansion of heat exchanger core 14 towards both outer wall 18 and inner wall 20 of pressure housing 12. Flex beam 16 supports heat exchanger core 14 away from pressure housing 12 such that heat exchanger core 14 is indirectly connected to pressure housing 12 by flex beam 16. Flex beam 16 separating heat exchanger core 14 from pressure housing 12 eliminates mechanical stress locations caused by pressure differentials at direct interfaces.

Heat exchanger 10 provides significant advantages. Flex beams 16 support heat exchanger core 14 in a floating configuration relative to pressure housing 12. Pressure housing 12 experiences mechanical stresses due to the pressure differential between the interior of pressure housing 12 and the environment surrounding pressure housing 12. The fluids flowing through heat exchanger core 14 are pressurized and generate mechanical stresses on heat exchanger core. Flex beams 16 support heat exchanger core 14 such that heat exchanger core 14 is not directly connected to pressure housing 12 but is instead connected by the elongate flex beams 16. Flex beams 16 provide elongate pathways for the temperature gradient between pressure housing 12 and heat exchanger core 14. The thermal pathways provided by flex beams 16 decouples that thermal stress and the mechanical stress from between heat exchanger core 14 and pressure housing 12. Flex beam 16 mechanically supports heat exchanger core 14 within pressure housing 12 and can form a seal that prevents fluid from bypassing heat exchanger core 14. Reducing the thermal and pressure stresses along the boundary between heat exchanger core 14 and pressure housing 12 can increase the efficiency of heat exchanger 10 by allowing heat exchanger core 14 to reach higher temperatures without being affected by the stresses. Flex beams 16 can further facilitate longer operating life by reducing the thermal and mechanical stresses, reducing downtime and providing cost savings.

Figure 2:
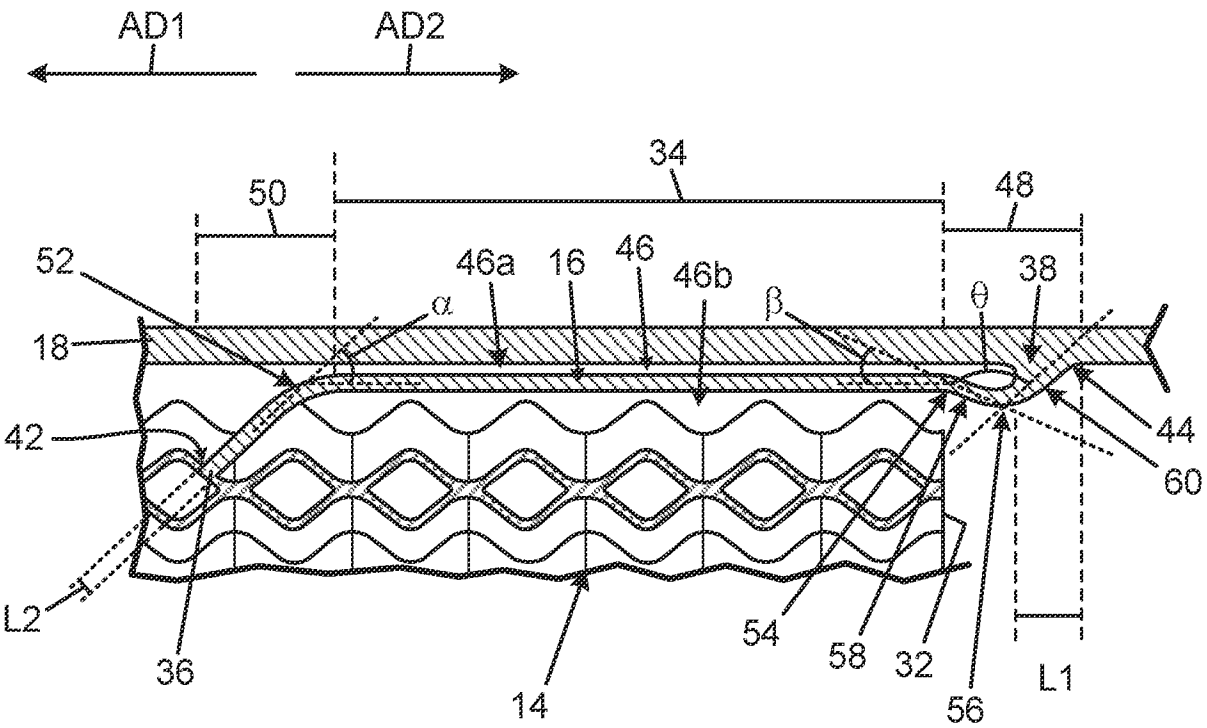
FIG. 2 is an enlarged view of detail 2 in FIG. 1B.

FIG. 2 is an enlarged view of detail 2 shown in FIG. 1B. Flex beam 16 includes flex beam body 34, housing end 38, core end 36, housing arm 48, core arm 50, core bend 52, first housing bend 54, and second housing bend 56.

Flex beam 16 extends between and connects pressure housing 12 and heat exchanger core 14. Flex beam 16 extends between core end 36 connected to heat exchanger core 14 and housing end 38 connected to pressure housing 12. Flex beam 16 extends radially and axially between pressure housing 12 and heat exchanger core 14. Flex beam 16 is configured such that flex beam 16 converges towards heat exchanger core 14 from housing end 38 to core end 36. Flex beam 16 converges towards axis A (FIG. 1B) from housing end 38 to core end 36. Flex beam 16 can, in some examples, be considered to be frustoconical.

Flex beam body 34 is a section of flex beam 16 that is elongated relative to axis A. Flex beam body 34 is shown as extending axially relative to axis A. In the example shown, flex beam body 34 is oriented axially, parallel to axis A. It is understood, however, that not all examples are so limited. For example, flex beam body 34 can be sloped and disposed transverse relative to axis A. In some embodiments, flex beam body 34 is not disposed parallel to heat exchanger core 14. In these embodiments, flex beam body 34 can be positioned at any desired angle relative to axis A. In the example shown, flex beam body 34 has a greater axial length (i.e., extends further along axis A) than core arm 50 and a greater axial length than housing arm 48. It is understood that flex beam body 34 can be any desired length, down to and including forming an inflection point where core arm 50 and housing arm 48 meet.

Housing arm 48 is disposed at a first axial end of flex beam body 34. In the example shown, housing end 38 is formed at an end of housing arm 48 opposite the end of housing arm 48 connected to flex beam body 34. As such, housing arm 48 is directly connected to pressure housing 12 by housing end 38. Housing arm 48 connects flex beam body 34 to pressure housing 12. In the example shown, housing arm 48 includes two axial ends. An inner end of housing arm 48 connects housing arm 48 to flex beam body 34. The inner end of housing arm 48 can also be referred to as a first axial end of housing arm 48. An outer end of housing arm 48 is disposed at an opposite end of housing arm 48 from flex beam body 34. Housing end 38 of flex beam 16 forms the outer end of housing arm 48, in the example shown. The outer end of housing arm 48 can also be referred to as a second axial end of housing arm 48. Housing end 38 connects flex beam 16 to pressure housing 12. Housing end 38 is formed as a part of housing arm 48 in the example shown.

Core arm 50 is disposed at a second axial end of flex beam body 34 opposite the first axial end of flex beam body 34. In the example shown, core end 36 is formed at an end of core arm 50 opposite the end of core arm 50 connected to flex beam body 34. As such, core arm 50 is directly connected to heat exchanger core 14 by core end 36. Core arm 50 connects flex beam body 34 to heat exchanger core 14. In the example shown, core arm 50 extends between two axial ends. An inner end of core arm 50 is the first axial end of core arm 50 that connects core arm 50 to flex beam body 34. An outer end of core arm 50 is disposed at an opposite end of core arm 50 from flex beam body 34. The inner end of core arm 50 can also be referred to as a first axial end of core arm 50. Core end 36 of flex beam 16 forms the outer end of core arm 50 in the example shown. The outer end of core arm 50 can also be referred to as a second axial end of core arm 50. Core end 36 connects flex beam 16 to heat exchanger core 14. Core end 36 is formed as a part of core arm 50 in the example shown.

In the example shown, flex beam 16 is elongate in a second axial direction AD2 from core end 36 to housing end 38. In some examples, the second axial direction AD2 can also be referred to as a downstream direction because at least one of the fluids flows in the second axial direction AD2. While flex beam 16 is shown as elongate in second axial direction AD2 from core end 36 to housing end 38, it is understood that not all examples are so limited. For example, flex beam 16 can be configured such that housing end 38 is spaced in first axial direction AD1 from core end 36. Housing end 38 can be disposed upstream of core end 36.

In the example shown, flex beam 16 is configured such that flex beam 16 extends axially beyond heat exchanger core 12. Flex beam 16 is elongate such that housing interface 44 is spaced axially from downstream end 32 of heat exchanger core 14. Flex beam 16 interfaces with pressure housing 12 such that housing interface 44 does not radially overlap with heat exchanger core 14 (i.e., a line extending radially from axis A does not extend through both heat exchanger core 14 and housing interface 44). In the example shown, housing arm 48 does not radially overlap with heat exchanger core 14. It is understood, however, that not all examples are so limited. In some examples, housing arm 48 can partially or fully radially overlap with heat exchanger core 14. In some examples, flex beam 16 is configured to extend beyond upstream end 30 of heat exchanger core 14. In some examples, flex beam 16 is configured such that all portions of flex beam 16 radially overlap with both pressure housing 12 and heat exchanger core 14.

Housing interface 44 is formed at a location where housing end 38 connects to pressure housing 12. Housing interface 44 has a length L1. It is understood that length L1 can vary depending on the desired structure of flex beam 16. Core interface 42 is formed at a location where core end 36 connects to heat exchanger core 14. Core interface 42 has a length L2. It is understood that length L2 can vary depending on the desired structure of flex beam 16. In the example shown, length L1 of housing interface 44 is larger than length L2 of core interface 42, though it is understood that not all examples are so limited. Length L1 is taken parallel to the axis A in the example shown due to the axial configuration of pressure housing 12. Length L2 is taken transverse to axis A in the example shown due to the shape of the heat exchanger core 14 at the core interface 42.

Flex beam 16 is co to flex in response to mechanical and thermal stresses to maintain heat exchanger core 14 in a floating relationship with pressure housing 12. In the example shown, flex beam 16 is shown as including multiple bends between core end 36 and housing end 38. The bends promote flex beam 16 acting as a spring arm to absorb deflections by heat exchanger core 14 and return heat exchanger core 14 to a desired floating position. Specifically in the example shown, flex beam 16 includes three bends, though it is understood that flex beam 16 can include more or less than three bends (e.g., zero, one, two, four, five, or more).

Core bend 52 is formed at the interface between core arm 50 and flex beam body 34. Core bend 52 reorients flex beam 16 from the transverse orientation of core arm 50 to the axial orientation of flex beam body 34, relative to axis A. Core bend 52 is bent at an acute angle $\alpha$. From core end 36, flex beam 16 extends radially and axially away from heat exchanger core 14.

First housing bend 54 and second housing bend 56 are disposed between flex beam body 34 and pressure housing 12. In the example shown, first housing bend 54 is formed at the interface between housing arm 48 and flex beam body 34. First housing bend 54 reorients flex beam from the axial orientation of flex beam body 34 to a transverse orientation of first portion 58 of housing arm 48. First housing bend 54 redirects flex beam 16 such that flex beam 16 extends axially and extends towards heat exchanger core 14. First housing bend 54 is formed as an acute angle β. In some examples, first housing bend 54 is formed as a mirror of core bend 52. In some examples, angle α is the same as angle β.

In the example shown, second housing bend 56 is formed in housing arm 48. Second housing bend 56 reorients flex beam from the transverse orientation of first portion 58 of housing arm 48 to a transverse orientation of second portion 60 of housing arm 48. Second housing bend 56 redirects flex beam 16 such that flex beam 16 extends axially and extends away from heat exchanger core 14 and towards pressure housing 12. Second housing bend 56 is formed as an obtuse angle θ.

Pressure housing 12 experiences mechanical stresses, which can also be referred to as pressure housing stress, due to the pressure differential between the interior of pressure housing 12 and the outside environment surrounding pressure housing 12 when heat exchanger core 14 and pressure housing 12 are connected directly. Mechanical stresses can also be created due to differences in pressure between heat exchanger core 14 and pressure housing 12. Fluids flowing through heat exchanger core 14 are pressurized and generate mechanical stresses on heat exchanger core 14. In addition to mechanical stresses, when heat exchanger core 14 and pressure housing 12 are directly connected thermal stresses occur. The difference in temperature between heat exchanger core 14 and pressure housing 12 create thermal stresses along the boundary between heat exchanger core 14 and pressure housing 12.

Flex beams 16 support heat exchanger core 14 such that heat exchanger core 14 is not directly connected to pressure housing 12 but is instead connected by elongated flex beams 16. Flex beams 16 provide elongate thermal pathways between pressure housing 12 and heat exchanger core 14, relative to a direct connection therebetween, that spread the thermal gradient out and decouple thermal stress and mechanical stresses from direct interface between the pressure housing 12 and heat exchanger core 14.

During operation, fluids flow through heat exchanger 10 to facilitate heat exchange. Due to varying temperatures between heat exchanger core 14 and pressure housing 12, flex beams 16 are configured to bend in response to thermal growth experienced during operation. Core bend 52, first housing bend 54, and second housing bend 56 promote flex beam 16 flexing in response to changes in temperature and pressure and flexing back to position when temperature and stresses decrease, minimizing thermal and mechanical stresses experienced by heat exchanger core 14 and pressure housing 12.

Figure 3:
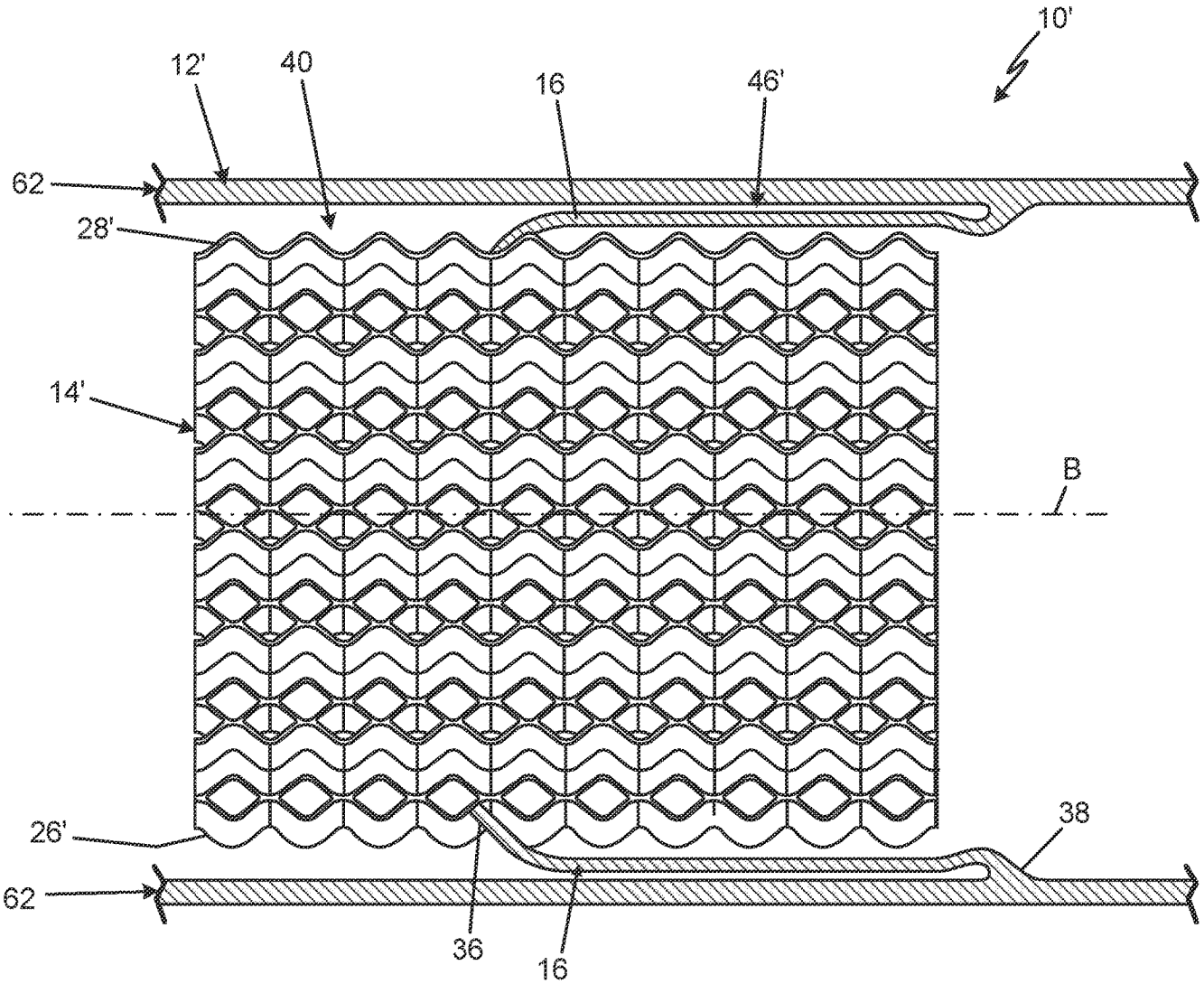
FIG. 3 is planar cross-sectional view of a heat exchanger.

FIG. 3 is planar cross-sectional view of a heat exchanger 10'. Pressure housing 12' includes housing wall 62. Housing wall 62 is substantially similar to outer housing wall 18 (FIGS. 1A and 1B) and inner housing wall 20 (FIGS. 1A and 1B), except that housing wall 62 wraps fully about the perimeter of heat exchanger core 14', whereas outer housing wall 18 extends about the outer radial side of heat exchanger core 14 and inner housing wall 20 extends about the inner radial side of heat exchanger core 14. Housing wall 62 can be formed to have a cross-section of any desired shape in a plane orthogonal to axis B, such as a circle, oval, square, rectangle, polygon, or any other desired shape.

Flex beam 16 includes core end 36 that connects to heat exchanger core 14' and housing end 38 that connects to pressure housing 12'. Flex beam 16 is substantially similar to flex beams 16 shown in FIGS. 1A-2, except that flex beam 16 extends fully about heat exchanger core 14' and interfaces with both inner side 26' and outer side 28' of heat exchanger core 14'. As such, heat exchanger 10' includes a single flex beam 16 that supports heat exchanger core 14' relative to pressure housing 12'.

Flex beam 16 supports heat exchanger core 14' such that heat exchanger core 14' floats within core chamber 40' defined by pressure housing 12'. Flex beam 16 supports heat exchanger core 14' such that support gaps 46' are formed between pressure housing 12' and heat exchanger core 14'. Heat exchanger core 14' is spaced radially from and not in contact with pressure housing 12'. Flex beam 16 wraps fully about the perimeter of heat exchanger core 14'.

Figure 4:
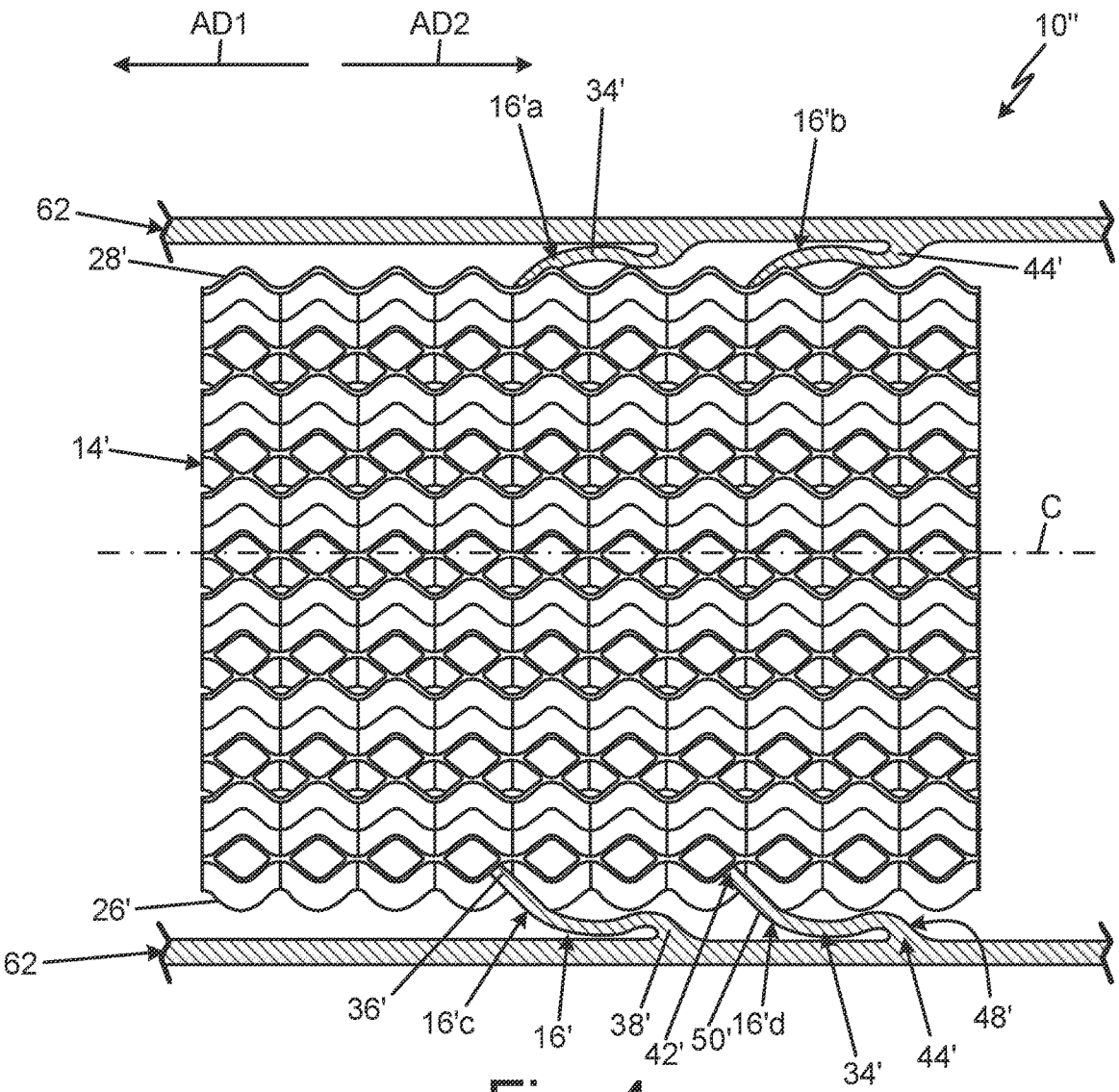
FIG. 4 is a planar cross-sectional view of a heat exchanger with multiple flex beams.

FIG. 4 is a planar cross-sectional view of heat exchanger 10". Heat exchanger 10" includes pressure housing 12', heat exchanger core 14', and flex beams 16'*a*-16'*d* (referred to collectively herein as "flex beam 16'" or "flex beams 16'").

Heat exchanger 10" is substantially similar to heat exchanger 10 (best seen in FIGS. 1A and 1B) and heat exchanger 10' (FIG. 3). Heat exchanger 10" can be of any desired configuration suitable for facilitating heat exchange between fluids. For example, pressure housing 12' can be formed with multiple housing walls 62 on both radial sides of heat exchanger core 14' (similar to pressure housing 12 (best seen in FIGS. 1A and 1B)) or from a single housing wall 62 that wraps fully about the perimeter of heat exchanger core 14'. Housing wall 62 can be formed to have a cross-section of any desired shape in a plane orthogonal to axis A, such as a circle, oval, square, rectangle, polygon, or any other desired shape. Similarly, heat exchanger core 14' can be formed as a ring (similar to heat exchanger core 14 (best seen in FIGS. 1A and 1B)) or in any other desired shape and configuration.

Flex beams 16' are substantially similar to flex beams 16 (best seen in FIG. 2). Flex beams 16' each include core end 36', housing end 38', and flex beam body 34'. Core end 36' connects to heat exchanger core 14' and housing end 38' connected to pressure housing 12'. Flex beams 16' each include housing arm 48' and core arm 50'. Housing arm 48' connects flex beam body 34' to housing wall 62. Core arm 50' connects flex beam body 34' to heat exchanger core 14'.

Heat exchanger 10" includes multiple flex beams 16' that are stacked axially. Flex beams 16' are stacked axially to axially overlap with each other (e.g., a line parallel to axis A can pass through each of the axially overlapping components). Flex beams 16' are stacked axially along inner radial side 26' of heat exchanger core 14' and outer radial side 28' of heat exchanger core 14'. In the example shown, flex beams 16' are formed in stacked pairs, though it is understood that any desired number of flex beams 16' can be stacked axially to support heat exchanger core 14'. Specifically in the example shown, flex beam 16'*a* and flex beam 16'*b* are disposed on outer side 28' of heat exchanger core 14'. Flex beam 16'*a* is spaced in first axial direction AD1 relative to flex beam 16'*b*. Flex beam 16'*a* axially overlaps with flex beam 16'*b*. Flex beam 16'*c* and flex beam 16'*d* are disposed on inner side 26' of heat exchanger core 14'. Flex beam 16'*c* is spaced in first axial direction AD1 relative to flex beam 16'*d*. Flex beam 16'*c* axially overlaps with flex beam 16'*d*. In some examples, each of flex beams 16'*a*-16'*d* is formed as a separate structure from the other ones of flex beams 16'*a*-16'*d*, similar to the two flex beams 16 shown in FIGS. 1A and 1B. In some examples, flex beams 16'*a*, 16'*c* are formed as a single flex beam that extends fully around the perimeter of heat exchanger core 14'. In some examples, flex beams 16'*b*, 16'*d* are formed as a single flex beam that extends fully around the perimeter of heat exchanger core 14'.

In the example shown, flex beam body 34' of flex beams 16' has a shorter length axially than flex beam body 34 (best seen in FIG. 2). It is understood that axial length of flex beam body 34' can vary depending on the desired structure of flex beam 16'. Flex beams 16' do not contact heat exchanger core 14' and pressure housing 12' at any location between core interface 42' and housing interface 44'. Flex beam body 34' does not contact heat exchanger core 14' and the pressure housing 12'.

Flex beams 16' are elongated in the second axial direction AD2 from the core end 36' to the housing end 38'. For each flex beam 16', housing end 38' is spaced in the second axial direction AD2 relative to core end 36'. It is understood that the direction of the flex beams 16' can vary depending on the desired structure of the flex beams 16'. In some examples, flex beams 16' are elongated in the first axial direction AD1, such that for each flex beam 16', housing end 38' is spaced in the first axial direction AD1 relative to core end 36'. In some examples, the axially stacked flex beams 16' can extend in opposite directions, towards or away from each other. For example, flex beam 16'*a* can be configured to extend in first axial direction AD1 from core end 36' to housing end 38' while flex beam 16'*b* is configured to extend in second axial direction AD2 from core end 36' to housing end 38'. As such, the two core ends 36' can be axially between the two housing ends 38'. In another example, flex beam 16'*a* can be configured to extend in second axial direction AD2 from core end 36' to housing end 38' while flex beam 16'*b* is configured to extend in first axial direction AD1 from core end 36' to housing end 38'. As such, the two housing ends 38' can be axially disposed between the two core ends 36'.

In the example shown, flex beams 16' interface with pressure housing 12' such that housing interfaces 44' radially overlap with heat exchanger core 14'. In the example shown, each housing arm 48' of each flex beam 16' radially overlaps with heat exchanger core 14'. It is understood, however, that not all examples are so limited. In some examples, one or more of the housing arms 48' can radially overlap with the heat exchanger core 14' partially, fully, or not at all. For example, housing arm 48' of flex beam 16'*b* can fully extend beyond heat exchanger core 14' to not radially overlap with heat exchanger core 14' while housing arm 48' of flex beam 16'*d* does partially or fully radially overlap with heat exchanger core 14'. Heat exchanger 10" provides significant advantages. The multiple axially-stacked flex beams 16' provide support at various locations along the axial length of heat exchanger core 14'. Increasing the number of flex beams 16' creates more physical connections to heat exchanger core 14'. Multiple flex beams 16' provide additional support to heat exchanger core 14' and can assist in balancing of heat exchanger core 14' in pressure housing 12'. Increasing a count of the flex beams 16' and providing axially shorter flex beams 16' can provide a cost-efficient and robust heat exchanger 10' in that heat exchanger core 14' is supported by multiple, smaller flex beams 16'. Increasing the number of flex beams can also decrease the stresses experienced by each individual flex beam 16', providing improved operating lifespan.

Discussion of Possible Embodiments

The following are non-exclusive descriptions of possible embodiments of the present invention.

A heat exchanger includes a heat exchanger core; a pressure housing at least partially defining a core chamber; and a flex beam extending between and connecting the heat exchanger core and the pressure housing such that the heat exchanger core is suspended away from the pressure housing within the core chamber by the flex beam, the flex beam including a core end connected to the heat exchanger core and a housing end spaced along the flex beam from the core end and connected to the pressure housing.

The heat exchanger of the preceding paragraph can optionally include, additionally and/or alternatively, any one or more of the following features, configurations and/or additional components:

A plurality of the flex beams connect the heat exchanger core and the pressure housing.

A plurality of the flex beams includes: a first flex beam, wherein the housing end of the first flex beam connects to an outer housing of the pressure housing and the core end connects to the heat exchanger core; and a second flex beam, wherein the housing end of the second flex beam connects to an inner housing of the pressure housing and the core end of the flex beam connects to the heat exchanger core.

The pressure housing extends about an axis and a flex beam is axially elongate such that the housing end is spaced axially from the core end.

The pressure housing includes a first housing on a radially outer side of the heat exchanger core and a second housing on a radially inner side of the heat exchanger core.

The pressure housing includes a first housing on a radially outer side of the heat exchanger core and a second housing on a radially outer side of the heat exchanger core. The first housing is cylindrical.

The pressure housing has a polygonal cross-section in a plane orthogonal to the axis.

The housing end of a flex beam connects to the pressure housing at a housing interface on an interior surface of the pressure housing; the core end of the flex beam connects to the heat exchanger core at a core interface on an exterior surface of the heat exchanger core; and the housing interface is spaced along the heat exchanger core from the core end.

A flex beam includes a flex beam body that extends fully around the heat exchanger core.

A flex beam includes a core arm extending between the core end and a flex beam body; a housing arm extending between the housing end and the flex beam body; a first bend disposed between the flex beam body and the housing end such that the flex beam extends towards the pressure housing between the first bend and the first housing end.

A flex beam includes a second bend disposed between the first bend and the flex beam body, wherein the flex beam extends towards the heat exchanger core from the second bend to the first bend.

A flex beam includes a second bend disposed between the first bend and the flex beam body, wherein the flex beam extends towards the heat exchanger core from the second bend to the first bend. A first bend and a second bend are disposed in a spacing gap formed between the heat exchanger core and the pressure housing.

A flex beam includes a third bend disposed between the core end and the flex beam body, the third bend configured such that the flex beam extends towards the heat exchanger core from the third bend to the core end.

A flex beam body extends straight, the second bend is disposed at an interface between the flex beam body and the housing arm, and the third bend is disposed at an interface between the flex beam body and the core arm.

A plurality of the flex beams are stacked axially and extend between and connect the pressure housing and the heat exchanger core.

A first flex beam of the plurality of flex beams extends in a first axial direction between the core end of the first flex beam and the housing end of the first flex beam relative to an axis of the heat exchanger, and wherein a second flex beam of the plurality of flex beams extends in the first axial direction between the core end of the second flex beam and the housing end of the second flex beam.

A first flex beam of the plurality of flex beams extends in a first axial direction between the core end of the first flex beam and the housing end of the first flex beam relative to an axis of the heat exchanger, and wherein a second flex beam of the plurality of flex beams extends in the first axial direction between the core end of the second flex beam and the housing end of the second flex beam. The housing end connects to the pressure housing at a housing interface having a first length, the core end connects to the heat exchanger core at a core interface having a second length, and the first length is greater than the second length.

The heat exchanger core does not directly contact the pressure housing.

A heat exchanger includes a heat exchanger core; a pressure housing at least partially defining a core chamber, the pressure housing extending about an axis; a first flex beam extending between and connecting the heat exchanger core and the pressure housing, the first flex beam comprising: a core arm extending between a core interface, at which a core end of the flex beam interfaces with the heat exchanger core, and a flex beam body of the first flex beam; a housing arm extending between a housing interface, at which a housing end of the flex beam interfaces with the pressure housing, and the flex beam body; wherein the flex beam body is elongate along the axis; wherein the core arm extends radially and axially between the flex beam body and the heat exchanger core; and wherein the housing arm extends radially and axially between the flex beam body and the pressure housing; wherein the first flex beam supports the heat exchanger core within the core chamber such that a spacing gap is formed radially between the heat exchanger core and the pressure housing.

The heat exchanger of the preceding paragraph can optionally include, additionally and/or alternatively, any one or more of the following features, configurations and/or additional components:

The first flex beam extends fully about the axis and forms a fluid-tight seal between the heat exchanger core and the pressure housing.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A heat exchanger comprising:

a heat exchanger core;

a pressure housing at least partially defining a core chamber; and a flex beam extending between and connecting the heat exchanger core and the pressure housing such that the heat exchanger core is suspended away from the pressure housing within the core chamber by the flex beam, the flex beam including a core end connected to the heat exchanger core and a housing end spaced along the flex beam from the core end and connected to the pressure housing;

wherein a radially inner edge of the flex beam is convex at a first point disposed between the housing end and the core end and a radially outer edge of the flex beam is concave at the first point; and wherein the radially inner edge of the flex beam is concave at a second point disposed between the housing end and the core end and the radially outer edge of the flex beam is convex at the second point.

2. The heat exchanger of claim 1, wherein a plurality of the flex beams connect the heat exchanger core and the pressure housing.

3. The heat exchanger of claim 2, wherein the plurality of the flex beams includes:

a first flex beam, wherein the housing end of the first flex beam connects to an outer housing of the pressure housing and the core end connects to the heat exchanger core; and a second flex beam, wherein the housing end of the second flex beam connects to an inner housing of the pressure housing and the core end of the flex beam connects to the heat exchanger core.

4. The heat exchanger of claim 1, wherein the pressure housing extends about an axis and the flex beam is axially elongate such that the housing end is spaced axially from the core end.

5. The heat exchanger of claim 4, wherein the pressure housing includes a first housing on a radially outer side of the heat exchanger core and a second housing on a radially inner side of the heat exchanger core.

6. The heat exchanger of claim 5, wherein the first housing is cylindrical.

7. The heat exchanger of claim 4, wherein the pressure housing has a polygonal cross-section in a plane orthogonal to the axis.

8. The heat exchanger of claim 1, wherein:

the housing end of the flex beam connects to the pressure housing at a housing interface on an interior surface of the pressure housing;

the core end of the flex beam connects to the heat exchanger core at a core interface on an exterior surface of the heat exchanger core; and the housing interface is spaced along the heat exchanger core from the core interface.

9. The heat exchanger of claim 1, wherein the flex beam includes a flex beam body that extends fully around the heat exchanger core.

10. The heat exchanger of claim 1, wherein the flex beam comprises:

a core arm extending between the core end and a flex beam body;

a housing arm extending between the housing end and the flex beam body; and a first bend disposed between the flex beam body and the housing end such that the flex beam extends towards the pressure housing between the first bend and the first housing end.

11. The heat exchanger of claim 10, wherein the flex beam includes a second bend disposed between the first bend and the flex beam body, wherein the flex beam extends towards the heat exchanger core from the second bend to the first bend.

12. The heat exchanger of claim 11, wherein the first bend and the second bend are disposed in a spacing gap formed between the heat exchanger core and the pressure housing.

13. The heat exchanger core of claim 11, wherein the flex beam includes a third bend disposed between the core end and the flex beam body, the third bend configured such that the flex beam extends towards the heat exchanger core from the third bend to the core end.

14. The heat exchanger core of claim 13, wherein the flex beam body extends straight, the second bend is disposed at an interface between the flex beam body and the housing arm, and the third bend is disposed at an interface between the flex beam body and the core arm.

15. The heat exchanger of claim 1, wherein a plurality of the flex beams are stacked axially and extend between and connect the pressure housing and the heat exchanger core.

16. The heat exchanger of claim 15, wherein a first flex beam of the plurality of flex beams extends in a first axial direction between the core end of the first flex beam and the housing end of the first flex beam relative to an axis of the heat exchanger, and wherein a second flex beam of the plurality of flex beams extends in the first axial direction between the core end of the second flex beam and the housing end of the second flex beam.

17. The heat exchanger of claim 1, wherein the housing end connects to the pressure housing at a housing interface having a first length, the core end connects to the heat exchanger core at a core interface having a second length, and the first length is greater than the second length.

18. The heat exchanger of claim 1, wherein the heat exchanger core does not directly contact the pressure housing.

19. A heat exchanger comprising:

a heat exchanger core;

a pressure housing at least partially defining a core chamber, the pressure housing extending about an axis; and a first flex beam extending between and connecting the heat exchanger core and the pressure housing, the first flex beam comprising:

a core arm extending between a core interface, at which a core end of the flex beam interfaces with the heat exchanger core, and a flex beam body of the first flex beam; and a housing arm extending between a housing interface, at which a housing end of the flex beam interfaces with the pressure housing, and the flex beam body, the housing arm including a first bend disposed between the flex beam body and the housing end such that the flex beam extends towards the pressure housing between the first bend and the housing end and a second bend disposed between the first bend and the flex beam body, such that the flex beam extends radially inward from the second bend to the first bend and the flex beam extends radially outward from the first bend to the housing end;

wherein the flex beam body is elongate along the axis;

wherein the length of the flex beam body is greater than the length of the housing arm;

wherein the core arm extends radially and axially between the flex beam body and the heat exchanger core;

wherein the housing arm extends radially and axially between the flex beam body and the pressure housing; and wherein the first bend and second bend are disposed in a spacing gap formed between the heat exchanger core and the pressure housing;

wherein the first flex beam supports the heat exchanger core within the core chamber such that a spacing gap is formed radially between the heat exchanger core and the pressure housing.

20. The heat exchanger of claim 19, wherein the first flex beam extends fully about the axis and forms a fluid-tight seal between the heat exchanger core and the pressure housing.

* * * * *